United States Patent [19]

Michel et al.

[11] 4,192,110

[45] Mar. 11, 1980

[54] ASSEMBLY POSITIONING A CRANE ON A PLATFORM INSTALLED IN THE SEA

[75] Inventors: Dominique Michel; Alain G. N. Noblanc, both of Paris, France

[73] Assignee: Compagnie Generale pour les Developpements, Operationnels des Richesses Sous-Marines, "C. G. Doris", Paris, France

[21] Appl. No.: 841,372

[22] Filed: Oct. 12, 1977

[30] Foreign Application Priority Data

Oct. 12, 1976 [FR] France ..... 76 30587

[51] Int. Cl.[2] ..... E04H 12/34

[52] U.S. Cl. ..... 52/111; 52/123

[58] Field of Search ..... 52/111, 118, 123; 405/195, 198; 61/90, 91, 92; 182/141, 66, 148

[56] References Cited

U.S. PATENT DOCUMENTS

| | | | |
|---|---|---|---|
| 3,106,299 | 10/1963 | Pingan | 52/111 |
| 3,185,265 | 5/1965 | White | 52/111 |
| 3,397,545 | 8/1968 | Leavitt | 61/90 |
| 3,477,235 | 11/1969 | Branham | 61/95 |
| 3,495,370 | 2/1970 | Habro | 52/118 |
| 3,945,212 | 3/1976 | Mo | 61/94 |
| 4,015,686 | 4/1977 | Bushnell | 182/148 |

FOREIGN PATENT DOCUMENTS

| | | | |
|---|---|---|---|
| 315293 | 10/1919 | Fed. Rep. of Germany | 52/111 |
| 2418158 | 10/1975 | Fed. Rep. of Germany | 52/111 |
| 1102173 | 10/1955 | France | 52/111 |
| 1315212 | 12/1962 | France | 182/148 |
| 201042 | 5/1965 | Sweden | 52/111 |
| 465086 | 4/1937 | United Kingdom | 52/111 |

*Primary Examiner*—James A. Leppink
*Assistant Examiner*—Henry E. Raduazo
*Attorney, Agent, or Firm*—Neil F. Markva

[57] ABSTRACT

An assembly for positioning a crane mounted on a support and intended to overhang the platform of a platform structure having a base which rests on the bed of a body of water. The crane is located on the vertical axis of a column offset with respect to a central shaft which carries the platform. The assembly comprises a mobile shaft element contained in the upper part of the offset column and having a base with jacks or a block and tackle permitting its emergence as far as the upper level of the offset column. The lower face of the crane support carries a downwardly extending shaft element which has the same diameter as the mobile shaft element. The two shaft elements are substantially coaxial when the platform is carried on the central shaft so that they may be joined together and raised as a unit.

2 Claims, 11 Drawing Figures

ASSEMBLY POSITIONING A CRANE ON A PLATFORM INSTALLED IN THE SEA

BACKGROUND OF THE INVENTION

The invention relates to a platform structure intended to rest on the bottom of the sea or other body of water and to support installations generally assembled on a platform as high as possible above water level from some industrial or scientific organization, such as for exploration, oil production, or an electrical generating station. The handling operations are carried out with the aid of a crane.

Such a platform structure generally consists of a base resting on the bottom of the sea to support a platform comprising one or a multiplicity of bridges, intended for the installations, at a considerable height above the water, for example, 40 meters or more. An essential elements of this installation is the crane which can be used in the construction of the platform structure. Thus, it is one of the first items installed on the structure resting on the underwater bed. Preferably, the crane is generally located at a point which is offset with respect to the central shaft intended to support the platform, and in such a manner that its boom can extend over all parts of the platform and raise installations brought by boats which do not have to come too close to the platform.

Thus, this invention is restricted to cranes installed on the finished platform before the platform is placed on the base. However, for reasons of stability and because of the dynamic forces created during transport, the crane cannot be placed at its operational height which is very much above the level of the platform.

Thus, the crane is positively fixed on its support which, in its turn, is fixed to the platform in a temporary manner. This temporary relationship is not disturbed until the platform and the base have been brought together.

The installation of a self-raising platform with its vertical support- and guide-rails on the base of a structure has already been envisaged for the construction of works at sea which have to feature a crane mounted on a column which dominates the superstructure. The head of the crane support column is constructed subsequently through a hole in this platform and the crane is mounted on it. Afterward, the platform and the crane are raised in keeping with the construction to the height of the works and the column.

SUMMARY OF THE INVENTION

This invention proposes another solution to this problem, a solution which, under certain conditions, may permit a final positioning of the crane in a shorter time. Here, the platform is placed above the base and the crane is located exactly on the vertical axis of a column offset with respect to the shaft of the central support. A mobile shaft element is placed in this offset column and can be raised above the column.

On the other hand, the crane support carries another shaft element on its lower face. The shaft element has the same diameter as the mobile shaft element of the column, passes through the platform and can even project below it. The mobile shaft element rising from the column comes into contact with this downwardly extending shaft element and their two edges are solidly joined. After this joining, this shaft assembly continues to rise until the crane has reached its required height.

The circumference of the mobile shaft assembly is then united with the upper edge of the offset column and with the edge of the hole which provides a passage for the shaft through the platform.

The raising of the mobile shaft element may be done by means of jacks which cooperate with toothed racks arranged on the inside walls of the offset column. It can also be done by means of a block and tackle suspended on the base of the crane, the cable of which may be wound on the crane windlass. In this event, the shaft element in the offset column features pulleys on its base, over which the cables pass. The ends of the cables are fixed, on the one hand, to the inside wall of the column, near its upper edge, and, on the other hand, to a central ring intended for hooking on to the block and tackle.

BRIEF DESCRIPTION OF DRAWINGS

The following description with respect to the attached drawings, given as a non-limiting example, will explain how the invention can be carried out, characteristics which emerge from the drawings as well as from the text forming, of course, a part of the invention.

In the drawings.

DETAILED DESCRIPTION

Figure 1:
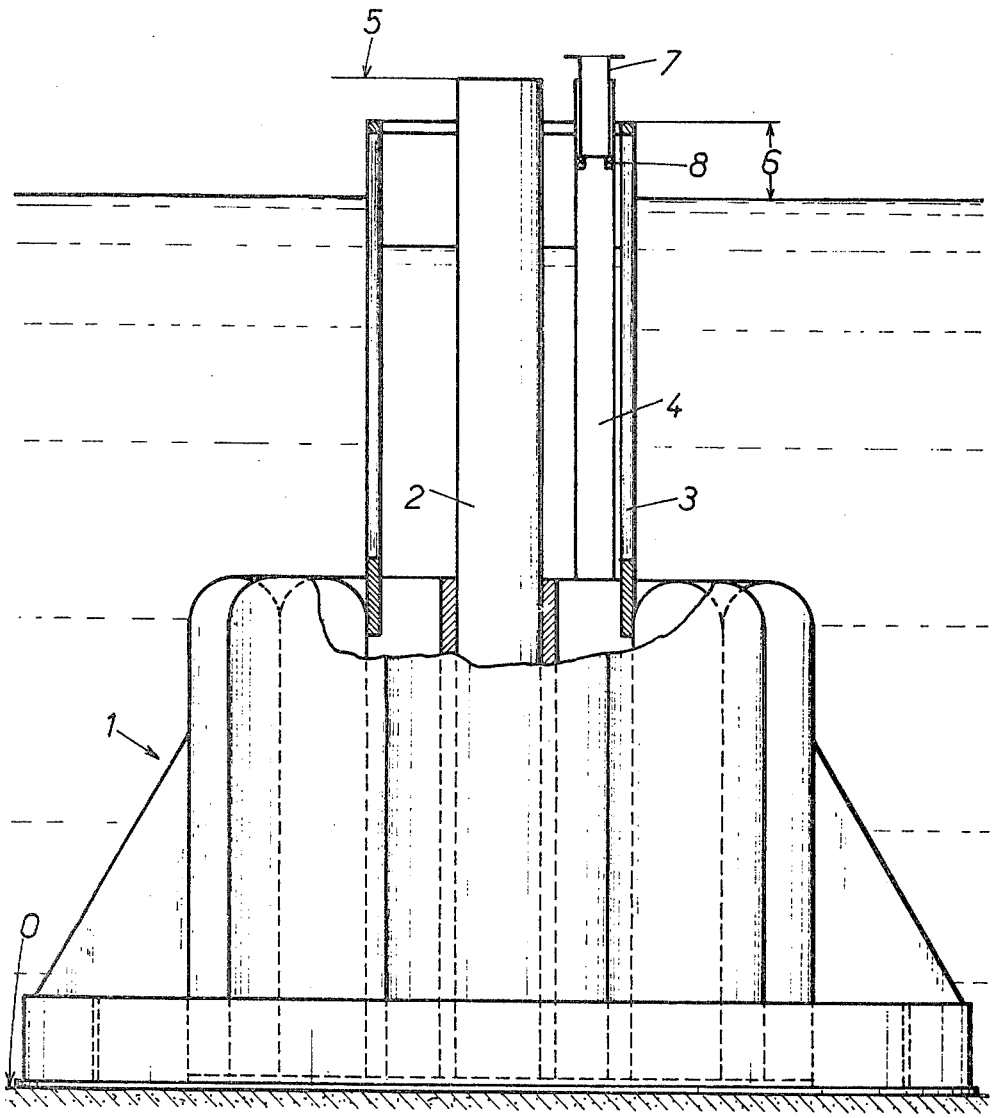
FIG. 1 shows an axial section of the base of the platform structure.

In FIG. 1, the finished base 1 is placed on the underwater bed at level 0. The central shaft 2, a cylindrical wall 3 (shown schematically), and an offset column 4, rise up to the required level 5 of the platform, which has not yet been brought into position. For this reason, the structure is still partly under ballast to obtain a freeboard 6 adapted to possible movements of the water line.

A mobile shaft element 7 is placed in column 4 and has a base which carries four equally spaced jacks 8 (see FIG. 2) resting on the teeth of racks 9 attached to the inside face of column 4. Jacks 8 are attached to lugs 10 projecting downwardly below an inwardly-turned flange 11 which partially closes the lower end of shaft element 7. The direction of jacks 8 is slightly inclined outwardly under the action of springs 12 which are braced between flange 11 and brackets 13 included on jacks 8. Small sockets 14 located on brackets 13 maintain springs 12 centered thereon.

While the number of jacks 8 can vary, there will always be an even number of jacks 8 distributed in an even manner around flange 11. There are four jacks 8 in this embodiment. However, the number is mainly a function of the dimension of supporting flange 11 (see also FIG. 3).

Figure 3:
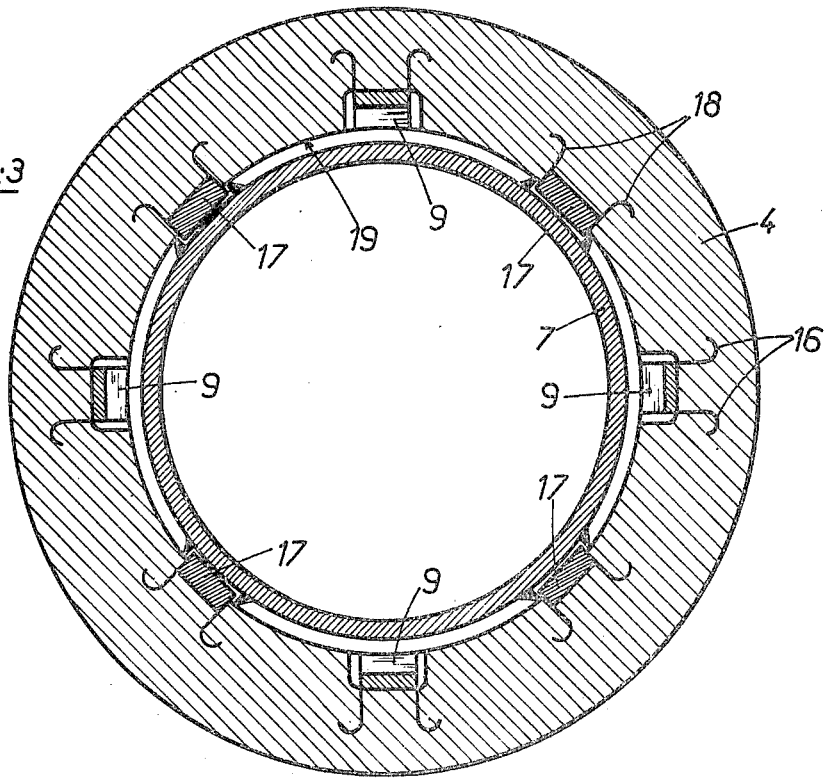
FIG. 3 shows a section along the line III—III of FIG. 2.

A pawl 15 is disposed on the end of the piston rod of each jack 8 and engages on one of the teeth of rack 9 on the inside of column 4. As shown in FIG. 3, racks 9 include fixing devices 16 which are embedded in the concrete of column 4. Slide rails 17 are fixed by hooks 18 and slightly project outwardly from the inside face 19 of column 4. Shaft element 7 is centered by rails 17, thus reducing the total frictional force and ensuring the correct functioning of the rack device.

Figure 4:
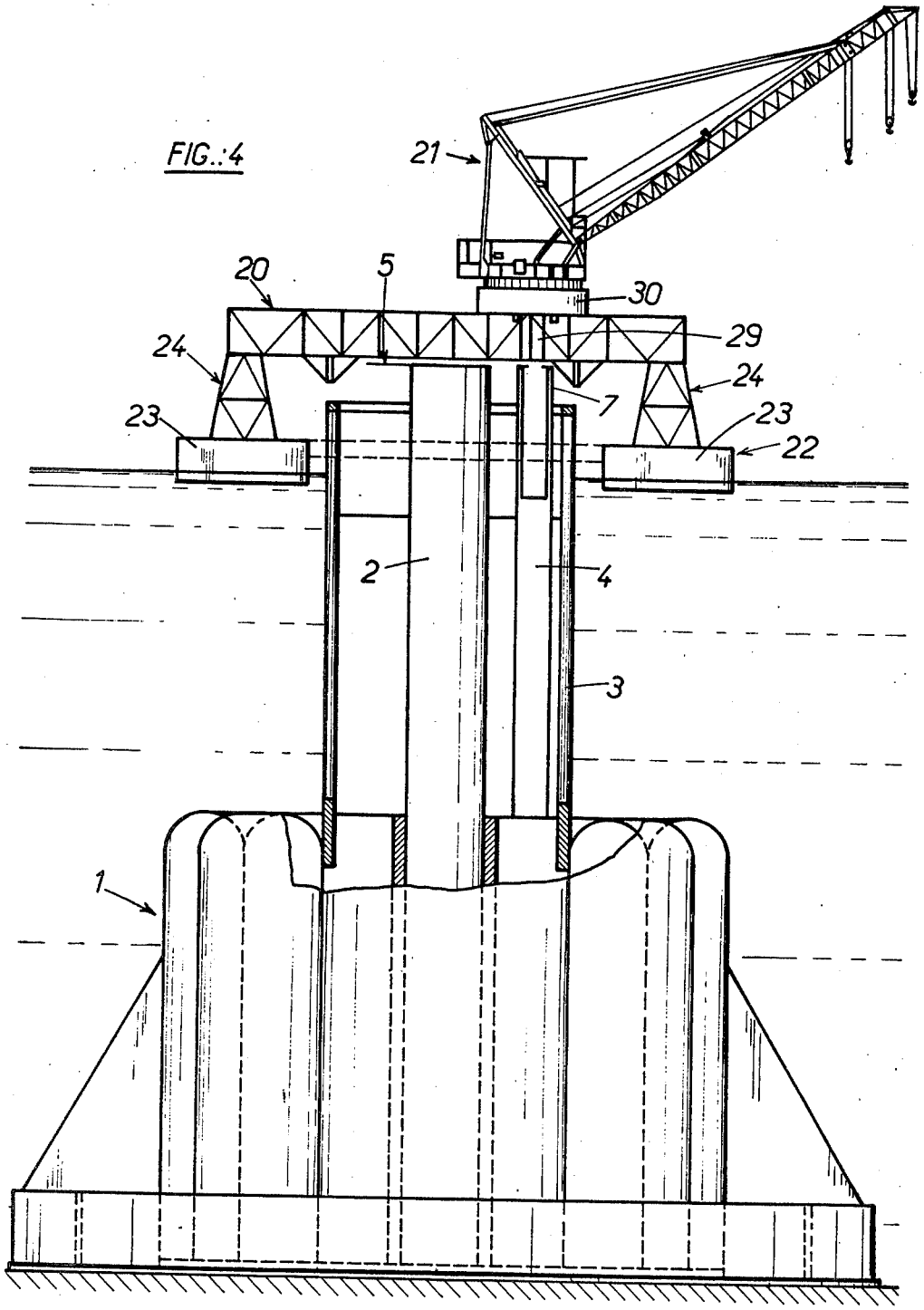
FIG. 4 shows an axial vertical section of the platform structure just before the positioning of the platform on the central shaft.
Figure 6:
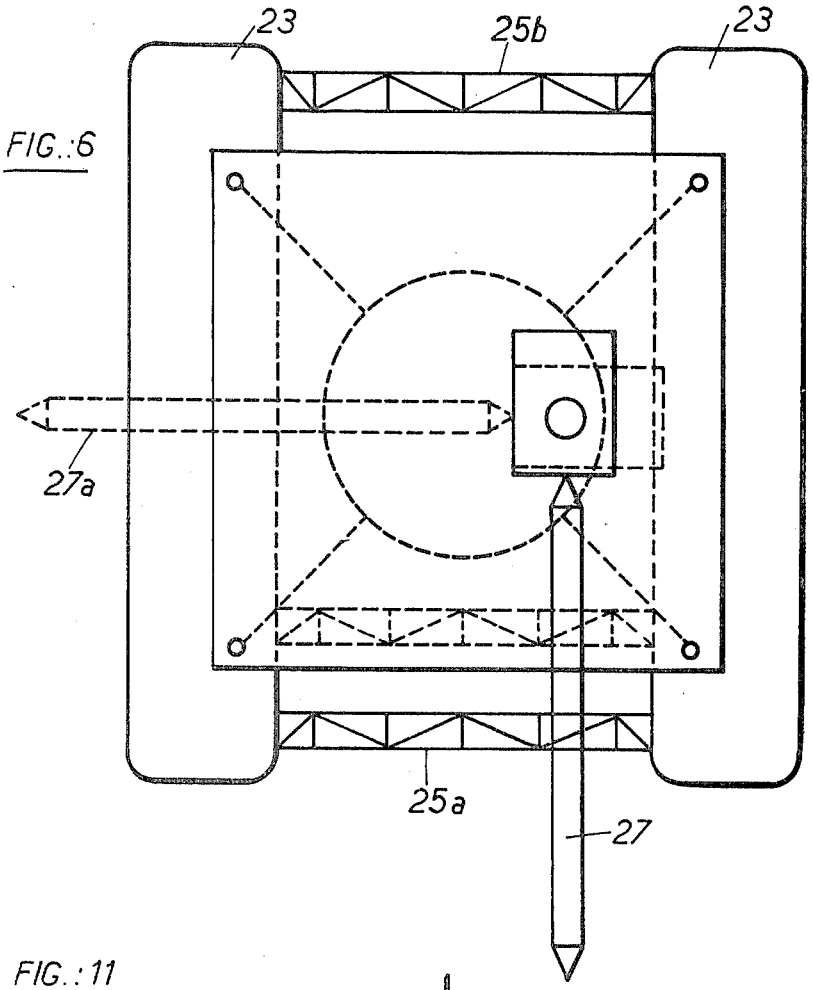
FIG. 6 shows the platform at the moment of centring it above the central shaft.

FIGS. 4 and 6 show a preferred method of positioning the platform 20 on base 1, in such a manner that, once this operation is finished, the crane 21 can be raised to the required height as quickly as possible so as to contribute to the assembly of installations on the platform. Cylindrical wall 3 is shown schematically in FIG. 4. Platform 20 is placed on a catamaran 22 made up of two barges 23 each having a supporting scaffolding structure 24 located thereon. Scaffolding structures 24 permit platform 20 to be maintained slightly above its required level 5, so that it can be maneuvered by passing above central shaft 2 and offset column 4. This position can be clearly seen in FIG. 4.

Figure 5:
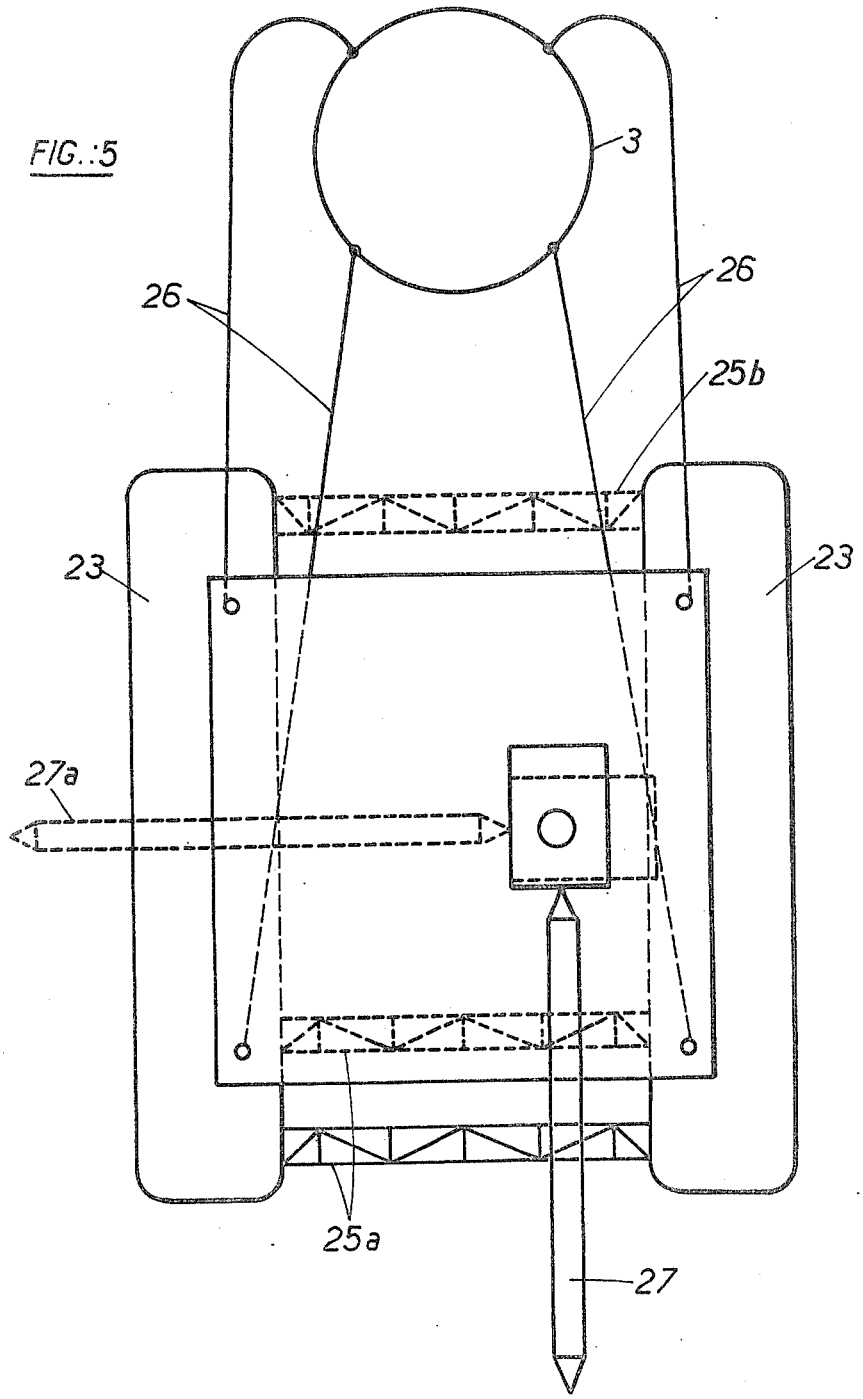
FIG. 5 shows, schematically, the platform.

Turning to FIG. 5, it is possible to follow the different stages for satisfactorily controlling this operation. The two barges 23 are connected together by two cross-elements 25*a*, 25*b* to form a catamaran. Windlasses (not shown) are installed on barges 23 and cables 26 are fixed to the cylindrical wall 3. Thus, it becomes possible to control the approach of the catamaran and to achieve its precise centering and direction with respect to base 1, i.e. especially with respect to shaft 2 and offset column 4.

In the course of this maneuver, one of the cross-elements 25*b* is temporarily removed and replaced after the prows of barges 23 have passed the tops of shaft 2 and offset column 4. Up to the termination of this stage of the operation, it is also preferable to lower boom 27 of crane 21 and to direct it towards the center of platform 20 (as shown at 27*a*). Boom 27 may rest on platform 20 to thereby lower the center of gravity of the assembly.

After centering platform 20 with respect to base 1, ballast water is pumped to lighten base 1 until the upper edges of central shaft 2 and offset column 4 come into contact with the lower face of platform 20. The consequence of this unballasting is to raise platform 20 until its entire weight rests on central shaft 2.

It is possible to raise crane 21 to the desired height on platform 20 during this maneuver. The jacks 8 start to operate alternately in pairs. Each time a pair of diametrically opposed jacks 8 is operated together. It may be advantageous to stagger the levels of the supporting surfaces 28 of the teeth of racks 9 of one pair with respect to the other. On pressurizing the upper chambers of jacks 8, two pawls 15 are first supported by surfaces 28. The bottom of shaft element 7 is raised until piston 8*a* of each jack 8 reaches the position on the right of FIG. 2.

Figure 2:
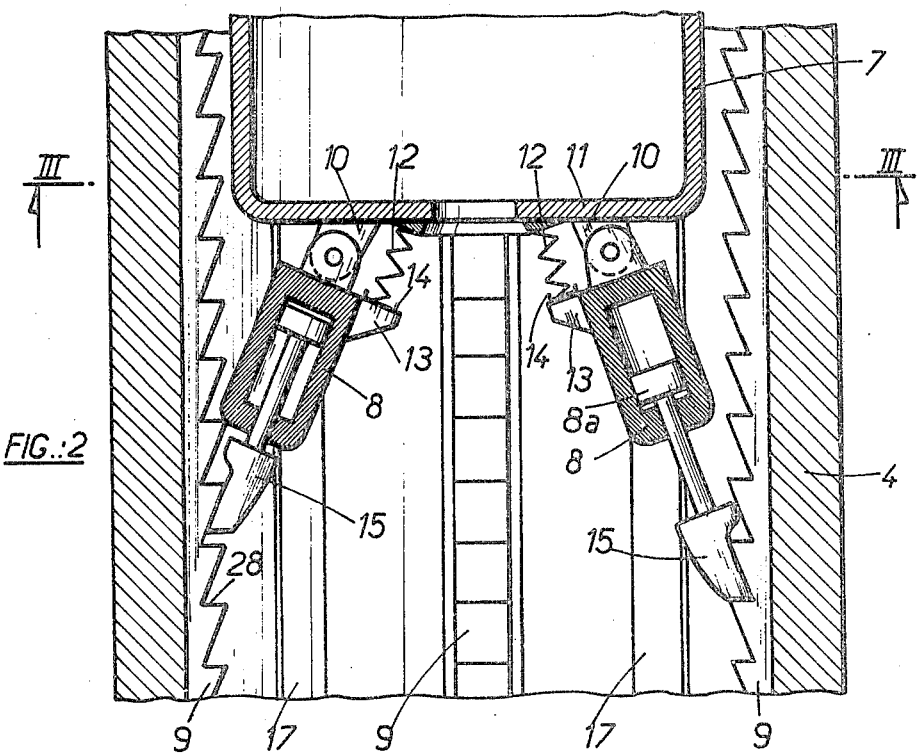
FIG. 2 shows an axial section through part of the offset column.

At this moment, another pair of jacks 8 is brought into operation. Once their pawls 15 have engaged surfaces 28 of rack 9 and their upper chambers have been pressurized, two actions take place. First, pawls 15 of the first pair of jacks 8 slide upwards under the action of jacks 8 whose pistons are approaching the finish of their strokes. Second, by pressurizing the lower chambers of the first pair of jacks 8, their pawls 15 are moved upwards by a larger step as shown in the left of FIG. 2. Thus, shaft element 7 slowly rises to meet another shaft element 29 which extends downwardly from support plate 30 on which crane 21 is mounted.

Figure 7:
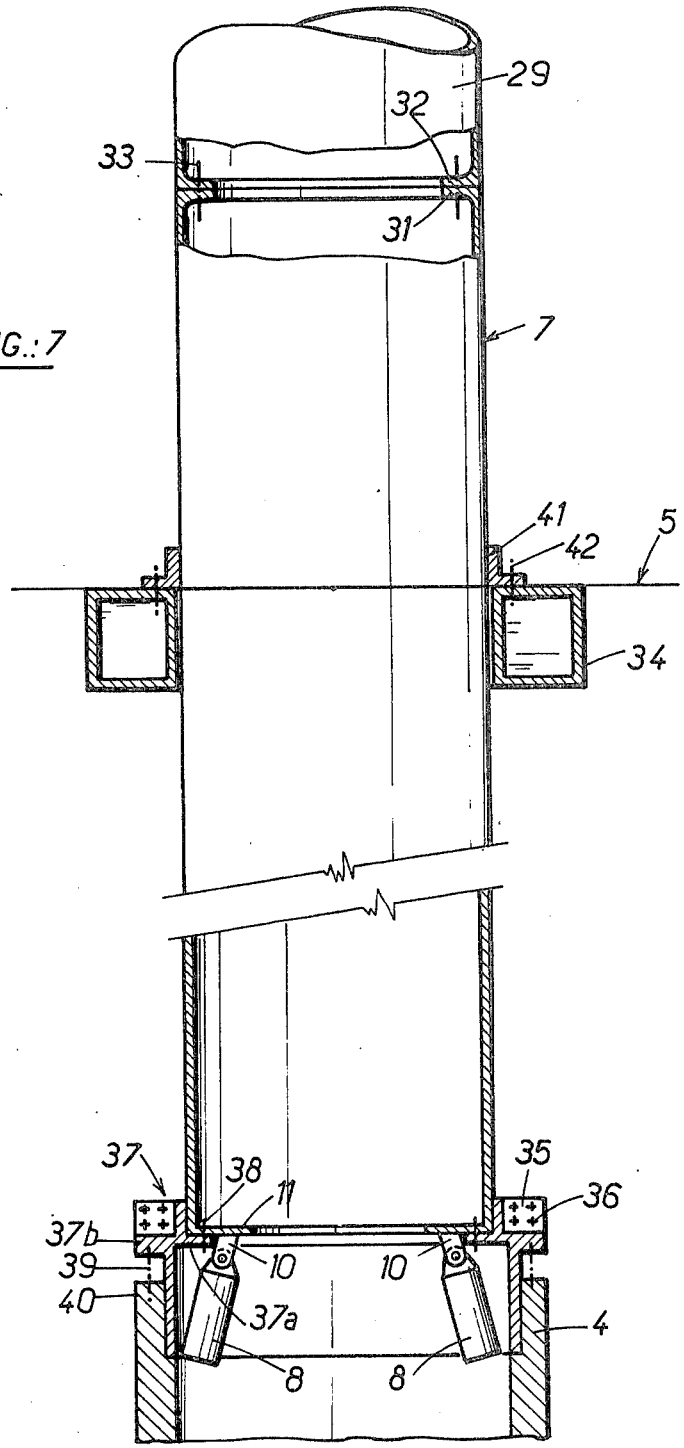
FIG. 7 shows an axial section of the shaft assembly and the top of the column after fixing of the shaft elements.

FIG. 7 shows the joining of these two shaft elements 7 and 29. Shaft element 7 has an internal flange 31 and shaft element 29 has a flange 32 at the end of each which has to be brought together with the other. Flanges 31 and 32 are joined by bolts 33. Man holes and ladders (not shown) inside shaft elements 7 and 29 access to personnel to the joining area, and to jacks 8 to permit their maintenance.

Figure 8:
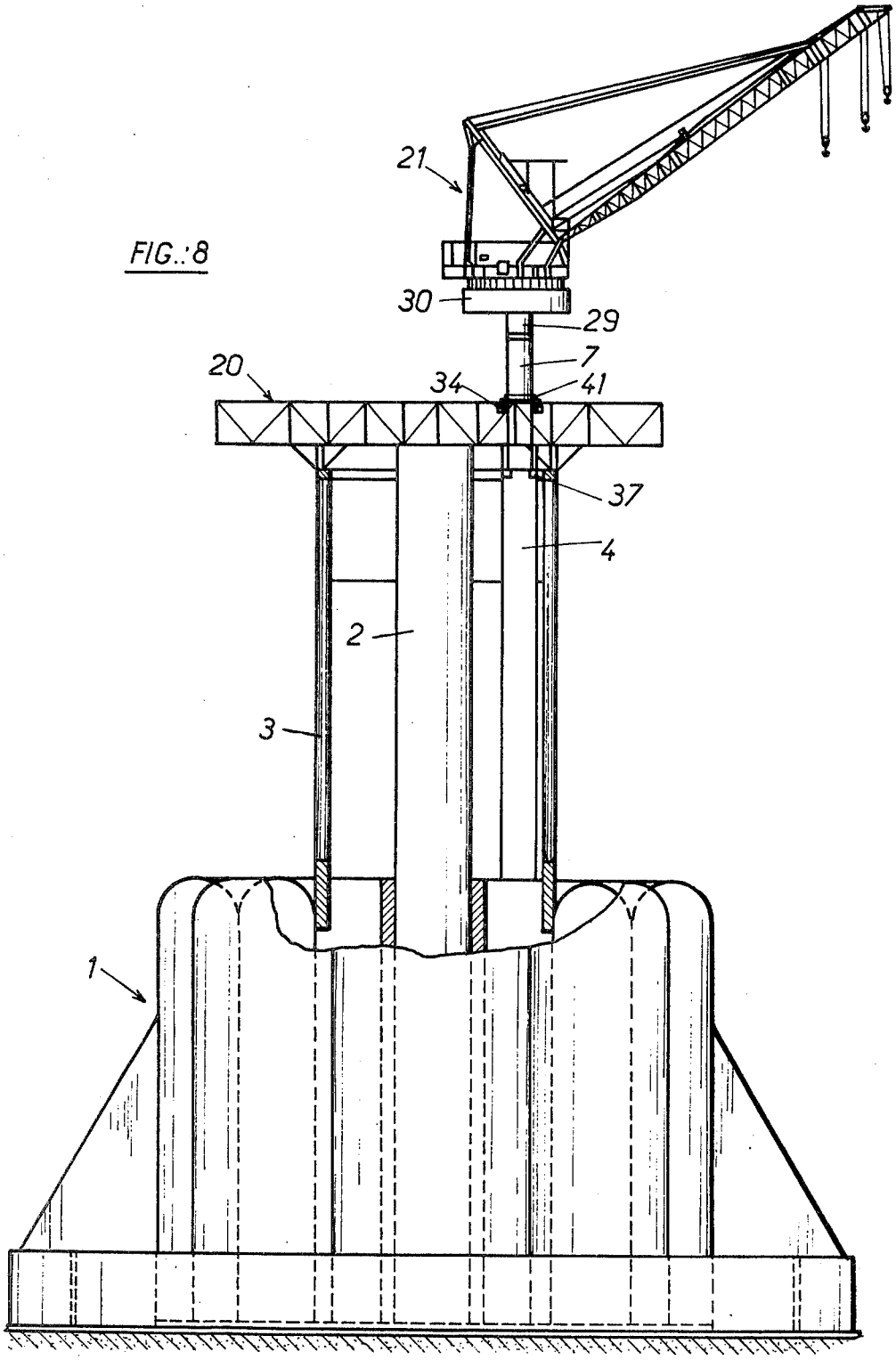
FIG. 8 shows an axial section of the platform structure in its last stage.

After joining of shaft elements 7 and 29 by flanges 31 and 32, the temporary attachments which have held crane 21 during movement of platform 20 are removed. The shaft elements 7 and 29 now form a unit, the use of which unit can be resumed. The assembled shaft 7 and 29 is centered below by slide rails 17 and is guided upwardly by a guide ring 34 fixed to platform 20. Thus, crane 21 rises as shown in FIG. 8. When the assembled shaft has reached the required height, it is positively fixed at the bottom to the upper end of column 4 and at a location higher than centering guide ring 34.

The lower connection is positioned first. A ring is made up of two half-circles 37 ending on their upper parts in radial rims 35. Rims 35 of the two half-circles 37 are joined together by bolts 36. The lower part of each half-circle 37 has a radial flange 37*a* extending inwardly on one side thereof and flange 37*b* extending outwardly on the other side thereof. Bolts 38 connect internal flange 37*a* to flange 11 of shaft element 7 and bolts 39 connect external flange 37*b* to a flange 40 which is integral with column 4.

An upper connection 41 is put in place subsequently and transmits shear forces in the horizontal plane to ring 34 fixed to platform 20 (which is only indicated by horizontal line 5 in FIG. 7). The connection 41 also comprises two half-circles which center lower shaft element 7 and are fixed directly to ring 34 by bolts and nuts 42.

Figure 9:
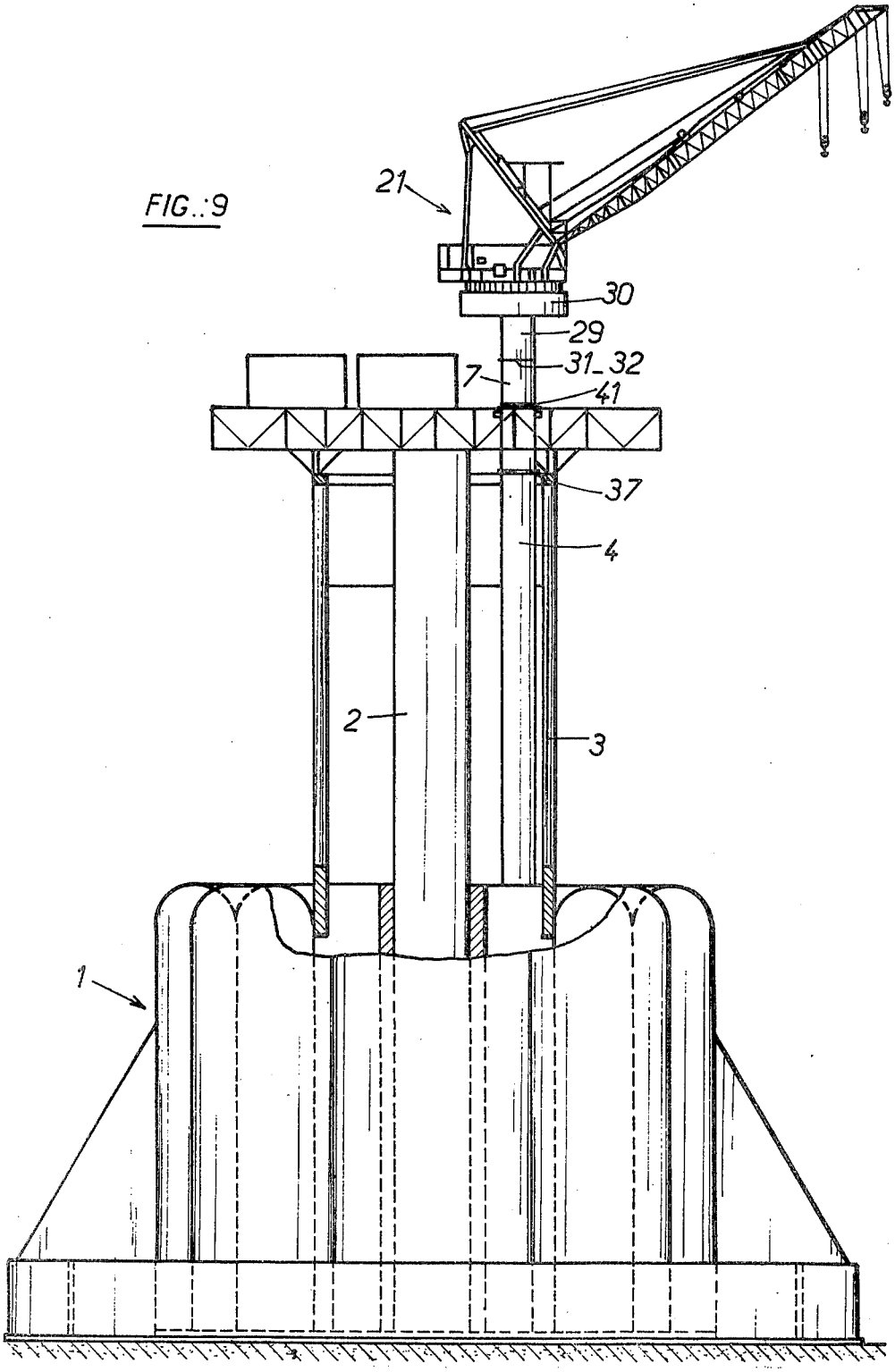
FIG. 9 shows an axial section of the structure after the crane has brought the first items onto the platform.

FIG. 9 shows crane 21 in its final position, having already started to assemble installations on platform 20.

Figure 11:
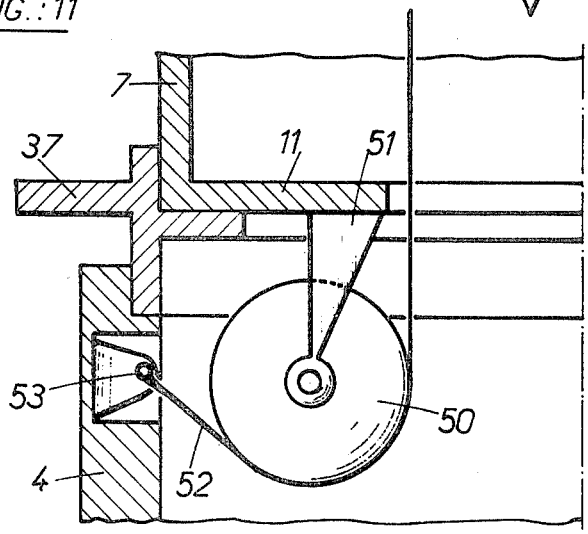
FIG. 11 shows, on a larger scale, the method of fixing mobile the shaft on the column.
Figure 10:
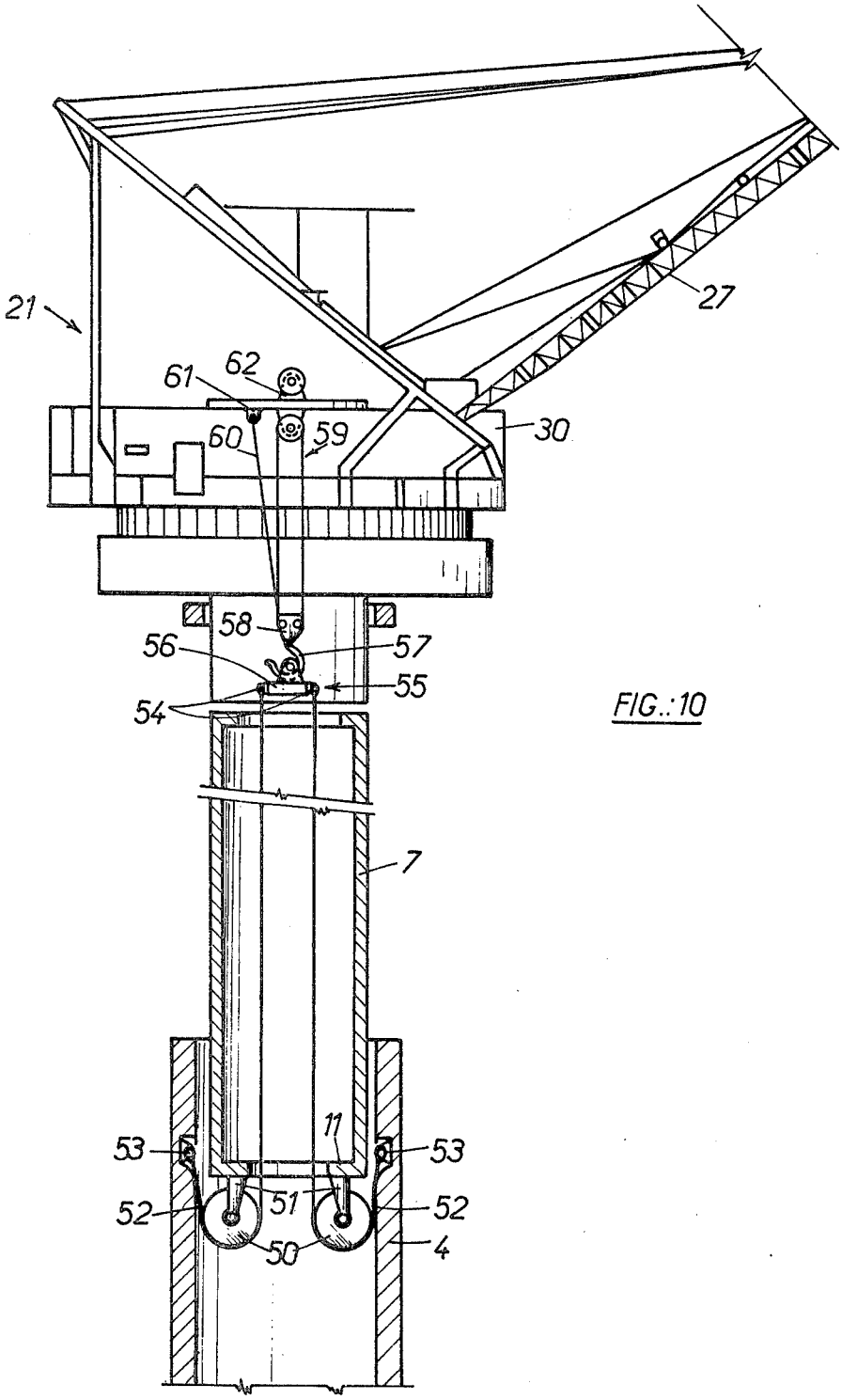
FIG. 10 shows a second embodiment of a device for raising the mobile shaft.

FIGS. 10 and 11 illustrate another system for joining the two shaft elements one to the other. Here, the windlass of crane 21 is used to raise shaft element 7. The principle of this system will be explained by referring to FIG. 10.

Supports 51 fix a plurality of pulleys 50 to flange 11 of the lower shaft element 7. A cable 52 passes round each pulley having one end attached to the inside of column 4, near its upper edge at connection 53. The other end 54 of each cable 52 is attached to a connection piece 55.

The connection piece 55 comprises a central ring 56 suspended from a hook 57 attached to the lower block 58 of a block and tackle 59. The dead end of cable 60 is attached to an eye 61 on support 30 of crane 21. The other end of cable 60 is actuated by a windlass 62.

In this embodiment, the block and tackle 59 is designed to raise a maximum load of between 1000 and 1600 tons. During the erection maneuver, the position of boom 27 will be brought as near the vertical as possible to reduce the decentralization of the center of gravity.

The weight of the type of cranes used on the bridge varies normally between 1500 and 3000 tons, it suffices to use blocks intended for 1.5 to 2 times the number of turns that can be taken around on the windlass.

Once the two shaft elements are joined together and fixed on offset column 4, block and tackle 59 can be recovered in the same manner as that indicated above. The windlass 62 can now return to operating the crane cable.

The embodiments described have only been given as examples and they can be modified, notably by the substitution of equivalent techniques, without departing from the scope of the invention as defined in the appended claims.

We claim:

1. An assembly for positioning a crane mounted on a crane support having a lower face, said crane intended to overhang the platform of a platform structure having a base which rests on the bed of a body of water, said assembly comprising:

(a) a central shaft for carrying said platform,
(b) a column offset with respect to the central shaft,
(c) a mobile shaft element contained in the upper part of said offset column and having a base means effective to emerge as far as the upper level of the offset column,
(d) a downwardly extending shaft element fixed on the lower face of the crane support,
(e) said shaft element having the same diameter as the mobile shaft element,
(f) the two shaft elements being substantially coaxial when the platform is carried on the central shaft,
(g) racks and side rails fitted to the inside wall of the offset column,
(h) said racks alternating with said side rails around the periphery of said inside wall, and
(i) two pairs of jacks carried on the bottom of the mobile shaft element and positioned to cooperate with the racks.

2. An assembly for positioning a crane mounted on a crane support having a lower face, said crane intended to overhang the platform of a platform structure having a base which rests on the bed of a body of water, said assembly comprising:

(a) a central shaft for carrying said platform,
(b) a column offset with respect to the central shaft,
(c) a mobile shaft element contained in the upper part of said offset column and having a base means effective to emerge as far as the upper level of the offset column,
(d) a downwardly extending shaft element fixed on the lower face of the crane support,
(e) said shaft element having the same diameter as the mobile shaft element,
(f) the two shaft elements being substantially coaxial when the platform is carried on the central shaft,
(g) a block and tackle having a cable and being suspended to the crane support,
(h) one of the ends of the block and tackle cable being fixed to the crane support,
(i) pulleys disposed on the base means of said mobile shaft element, and
(j) a cable passing over each said pulley and having one end thereof attached to the wall of the offset column, near to its upper edge, and the other end thereof attached to a central ring including means for connection to the block and tackle.

* * * * *